US006591516B2

(12) United States Patent
Kamada et al.

(10) Patent No.: US 6,591,516 B2
(45) Date of Patent: Jul. 15, 2003

(54) HAIR DRYER

(75) Inventors: Kenji Kamada, Hikone (JP); Yuji Yamane, Hikone (JP); Kazunori Nakasai, Hikone (JP); Kouji Asakawa, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 31 days.

(21) Appl. No.: 09/863,258

(22) Filed: May 24, 2001

(65) Prior Publication Data

US 2002/0174559 A1 Nov. 28, 2002

(51) Int. Cl.[7] ..... A45D 20/00; F04D 17/00

(52) U.S. Cl. ..... 34/97; 34/191; 415/58.5; 415/58.7

(58) Field of Search ..... 34/96, 97, 76, 34/191; 415/58.5, 58.7, 57.4, 208.5, 211.1, 220

(56) References Cited

U.S. PATENT DOCUMENTS 4,308,670 A * 1/1982 Bonnema ..... 34/97
4,871,294 A * 10/1989 Ivanov et al. ..... 415/58.7
5,230,605 A * 7/1993 Yamaguchi et al. ..... 415/151
5,551,841 A * 9/1996 Kamada ..... 417/89
6,302,640 B1 * 10/2001 McKelvey ..... 415/58.5

* cited by examiner

*Primary Examiner*—Pamela Wilson
(74) *Attorney, Agent, or Firm*—Oblon, Spivak, McClelland, Maier & Neustadt, P.C.

(57) ABSTRACT

A hair dryer including a main body, a centrifugal fan, at least one air inlet and at least one inlet guide. The main body has an air outlet. The centrifugal fan is provided in the main body and configured to blow air toward the air outlet. The centrifugal fan has an intake side and an outer circumferential surface around a central axis of the centrifugal fan. The at least one air inlet is formed in the main body to face the intake side of the centrifugal fan. The at least one inlet guide is provided to project from an inside surface of the main body and extends along a circumference of the at least one air inlet to surround and face a part of the outer circumferential surface of the centrifugal fan along a circumference of the centrifugal fan.

22 Claims, 9 Drawing Sheets

HAIR DRYER

BACKGROUND OF THE INVENTION

1. Field of the Invention

The present invention relates to a hair dryer.

2. Discussion of the Background

Referring to FIG. 7, a main body 1 of a hair drier has an air outlet 2 and air inlets 3 at side surfaces of the main body 1. The main body 1 accommodates a heater unit 5 and a blowing device 4. The blowing device 4 includes a motor 15 and a centrifugal-type centrifugal fan 6. The centrifugal fan 6 is fixed to a motor shaft 16.

In the conventional hair drier, as shown in FIG. 8, a reverse flow (C) which is generated because of the pressure loss at the heater unit 5 flows into the air inlet 3. Further, as shown in FIG. 9, a peripheral flow (D) which flows to the heater unit 5 without passing through the centrifugal fan 6. The reverse flow (C) and the peripheral flow (D) causes not only a decrease of air blowing efficiency but also an increase of air suction noise.

Considering these problems, as shown in FIG. 10, an inlet guide 33 which has a bell mouth shape is provided within the intake side (6*a*) of the centrifugal fan 6 and along the periphery of the air inlets 3. In this hair drier, however, burbly flow (E) is generated. Accordingly, as shown in FIG. 11, additional flow guide 34 which has a bell mouth shape is provided at the circumferential surface of the centrifugal fan 6. However, in the hair driers shown in FIGS. 10 and 11, the areas of the air inlets 3 and the area of the air outlet of the centrifugal fan 6 reduce due to the inlet guide 33 and the additional flow guide 34.

Japanese Unexamined Utility Model Publication (Kokai 60-155799) discloses an air inlet which has a bell mouth shape. The contents of this application are incorporated herein by reference in their entirety.

SUMMARY OF THE INVENTION

According to one aspect of the present invention, a hair dryer including a main body, a centrifugal fan, at least one air inlet and at least one inlet guide. The main body has an air outlet. The centrifugal fan is provided in the main body and configured to blow air toward the air outlet. The centrifugal fan has an intake side and an outer circumferential surface around a central axis of the centrifugal fan. The at least one air inlet is formed in the main body to face the intake side of the centrifugal fan. The at least one inlet guide is provided to project from an inside surface of the main body and extends along a circumference of the at least one air inlet to surround and face a part of the outer circumferential surface of the centrifugal fan along a circumference of the centrifugal fan.

According to another aspect of the present invention, a hair dryer including a main body, a centrifugal fan, at least one air inlet, at least one blowing guide and at least one inlet guide. The main body has an air outlet. The centrifugal fan is provided in the main body and configured to blow air toward the air outlet. The centrifugal fan has an intake side and an outer circumferential surface around a central axis of the centrifugal fan. The at least one air inlet is formed in the main body to face the intake side of the centrifugal fan. The at least one blowing guide has a concave space and is provided along a circumference of the centrifugal fan to face the inlet guide. The at least one inlet guide is provided to project from an inside surface of the main body and extends along a circumference of the at least one air inlet. A portion of the at least one inlet guide is positioned in the concave space along a circumferential length of the at least one inlet guide.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
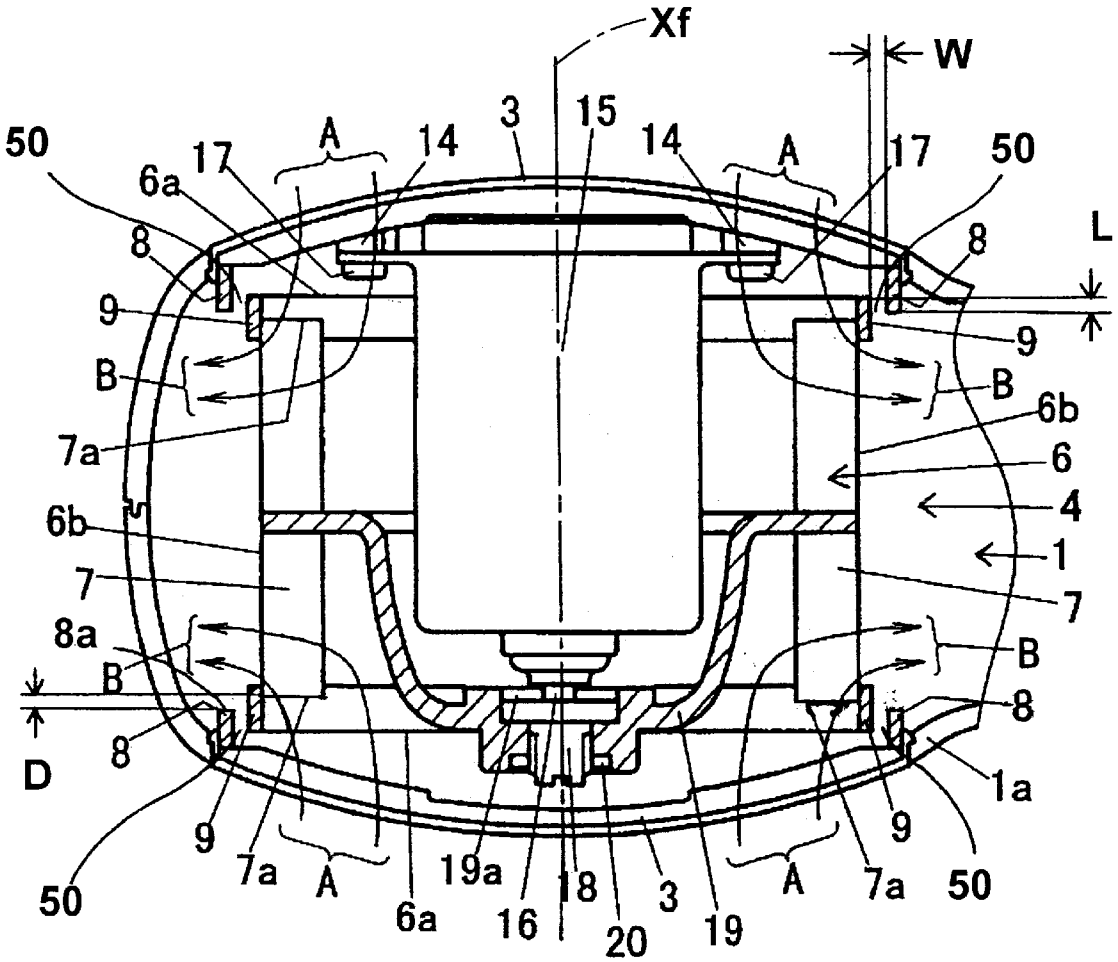
FIG. 1 is a partially cross-sectional view of a hair dryer according to an embodiment of the present invention.

The preferred embodiments will now be described with reference to the accompanying drawings, wherein like reference numerals designate corresponding or identical elements throughout the various drawings.

Figure 3:
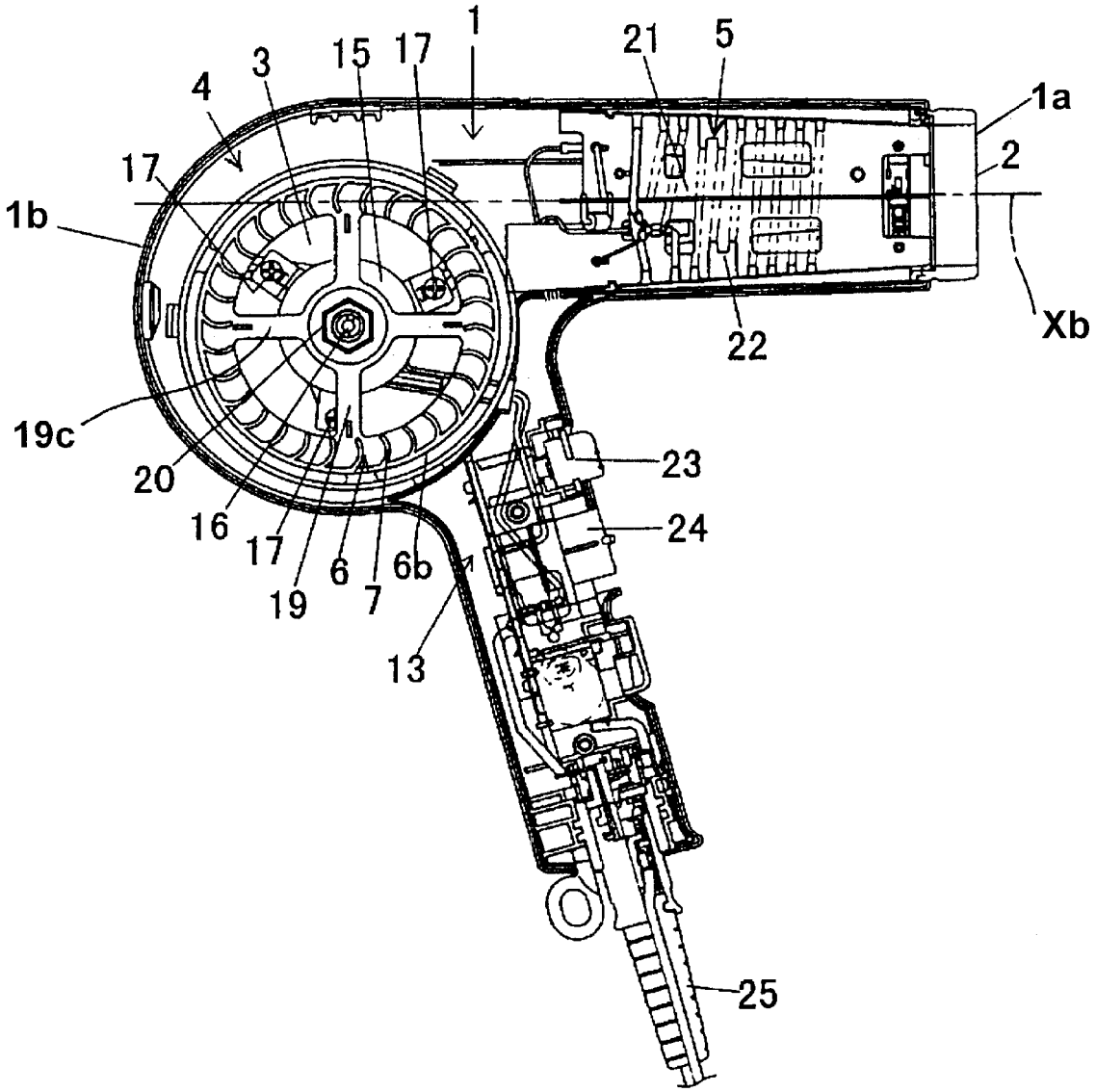
FIG. 3 is a sectional side view of the hair dryer shown in FIG. 2.

FIG. 3 is a sectional side view of a hair dryer according to an embodiment of the present invention. Referring to FIG. 3, a hair dryer 3 has a main body 1 which is, for example, generally cylindrical, and a handle 13 extending from the main body 1 at an angle.

Figure 2:
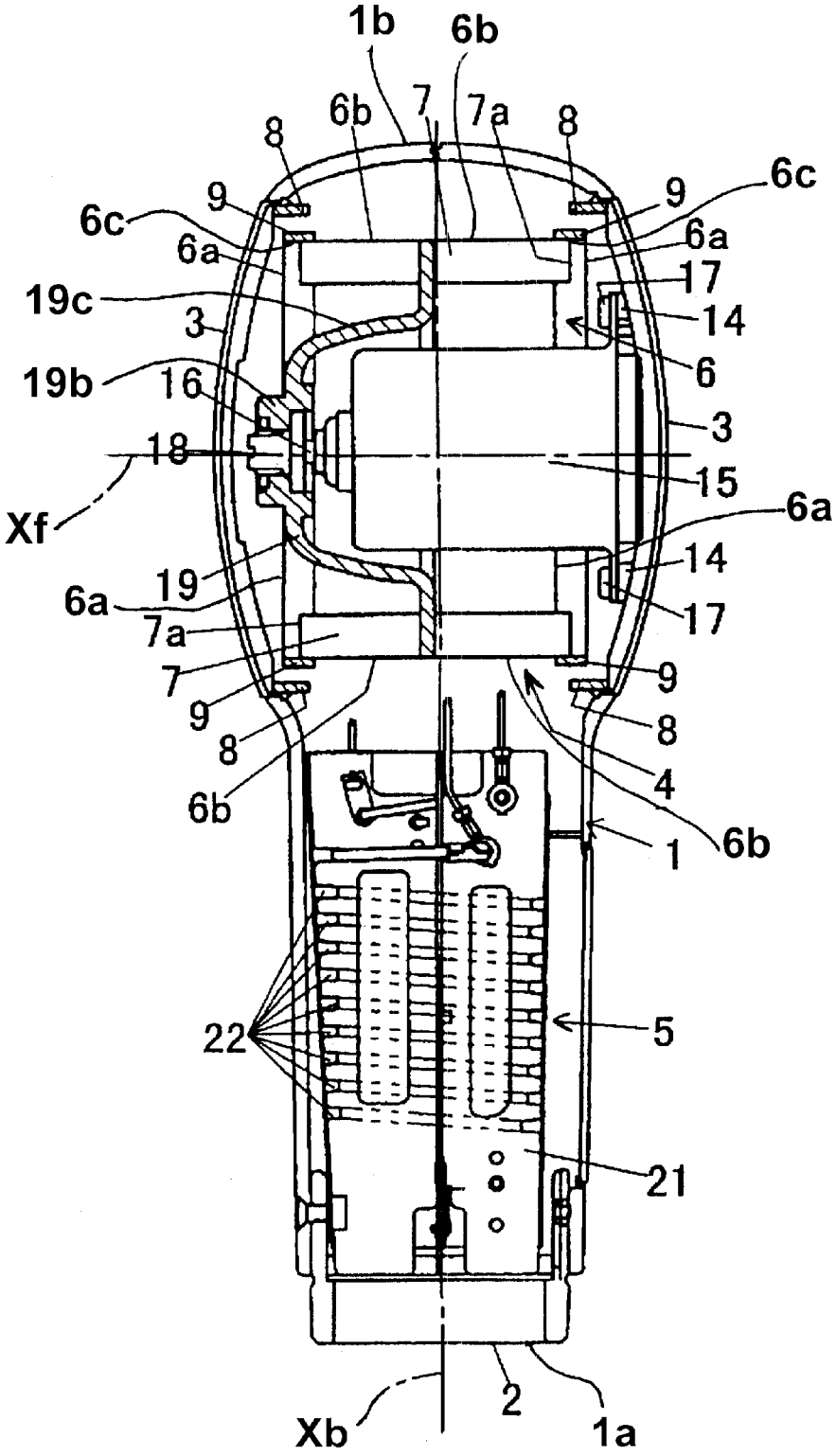
FIG. 2 is a sectional top plan view of the hair dryer shown in FIG. 1.

FIG. 2 is a sectional top plan view of the hair dryer shown in FIG. 3. FIG. 1 is a partially cross-sectional view of the hair dryer. Referring to FIGS. 1–3, the main body 1 extends along a body central axis (Xb) from a front end (1*a*) to a rear end (1*b*). The main body 1 has an air outlet 2 at the front end (1*a*) of the main body 1 and air inlets 3 at side surfaces of the main body 1 near the rear end (1*b*) of the main body 1. Although the main body 1 has two air inlets 3 in the present embodiment, the main body 1 may have at least one air inlet. The air inlets 3 are openings which have generally round shapes (see FIG. 3) and face respective intake sides (6*a*) of a centrifugal fan 6 which will be described hereinafter. The diameter of the air inlet 3 is equal to or larger than the diameter of the centrifugal fan 6. Inlet guides 8 which have generally ring shapes are provided to project from an inside surface of the main body 1. Each inlet guide 8 extends along an entire circumference of the air inlet 3. Accordingly, the inlet guide 8 surrounds the centrifugal fan 6 along the entire circumference of the centrifugal fan 6 and face a portion of the outer circumferential surface (6*b*) of the centrifugal fan 6. The inlet guide 8 may extend along a part of the entire circumference of the air inlet 3. Accordingly, the inlet guide 8 may surround the centrifugal fan 6 along a part of the entire circumference of the centrifugal fan 6. Screw fixed portions 14 are provided in one air inlet 3.

The main body 1 accommodates a heater unit 5 and a blowing device 4. The heater unit 5 is provided near the air outlet 2 and the blowing device 4 is provided near the air inlets 3. The blowing device 4 includes a motor 15 and a centrifugal fan 6. The centrifugal fan 6 has, for example, a plurality of blades. The centrifugal fan 6 has a generally cylindrical shape and is fixed to a motor shaft 16 of the motor 15 at the center of the centrifugal fan 6. The centrifugal fan 6 is provided in the main body 1 such that a central axis (Xf) of the centrifugal fan 6 is substantially perpendicular to the body central axis (Xb) of the main body 1. The inlet guides 8 are provided to have the common central axis (Xf). Blades 7 are provided along the outer circumferential surface (6*b*) of the centrifugal fan 6. The centrifugal fan 6 includes ring-shaped blowing guides 9. Each blowing guide 9 is provided along the outer circumferential surface (6*b*) of the centrifugal fan 6 at each side end portion (6*c*) along an entire circumference of the centrifugal fan 6. The blowing guide 9 may extend along a part of the entire circumference of the centrifugal fan 6. Each blade 7 is fixed to the blowing guides 9. A rib 19 is provided in the centrifugal fan 6. The rib 19 has, for example, a generally round-shaped center portion (19*b*) and four connecting legs (19*c*) which extend from the center portion (19*b*) every 90° (see FIG. 3). Each connecting leg (19*c*) connects the center portion (19*b*) and the blade 7 at the center along the longitudinal direction of the blade 7 (see FIG. 2). The center portion (19*b*) is connected to the motor shaft 16 via a connector 18 such that the centrifugal fan 6 and the motor shaft 16 have a common central axis (Xf). The bottom of the motor 15 is fixed to the screw fixed portions 14 via screws 17.

Figure 8:
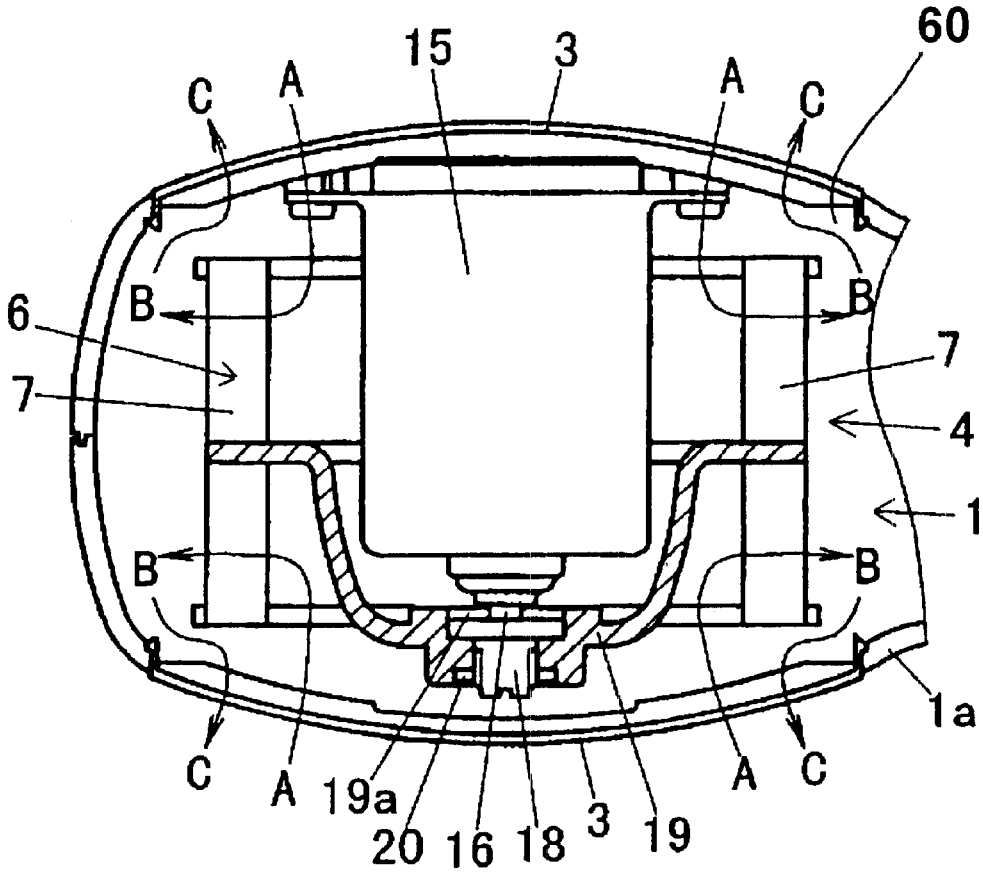
Fig. 8 Conventional Art
FIG. 8 is a partially cross-sectional view of the conventional hair dryer shown in FIG. 7.
Figure 9:
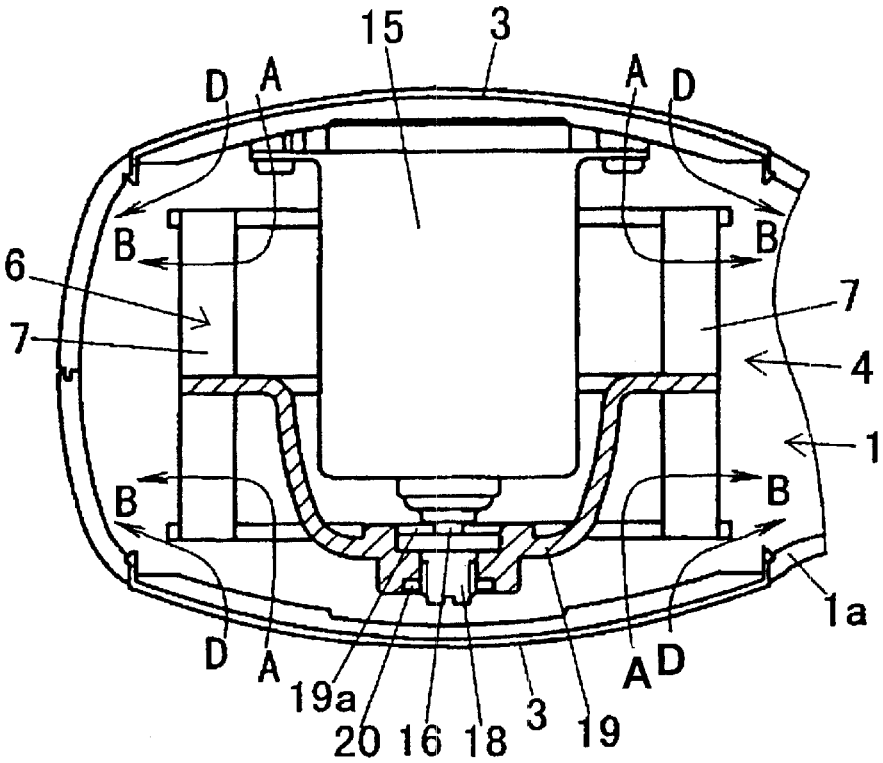
Fig. 9 Conventional Art
FIG. 9 is a partially cross-sectional view of the conventional hair dryer shown in FIG. 7.
Figure 10:
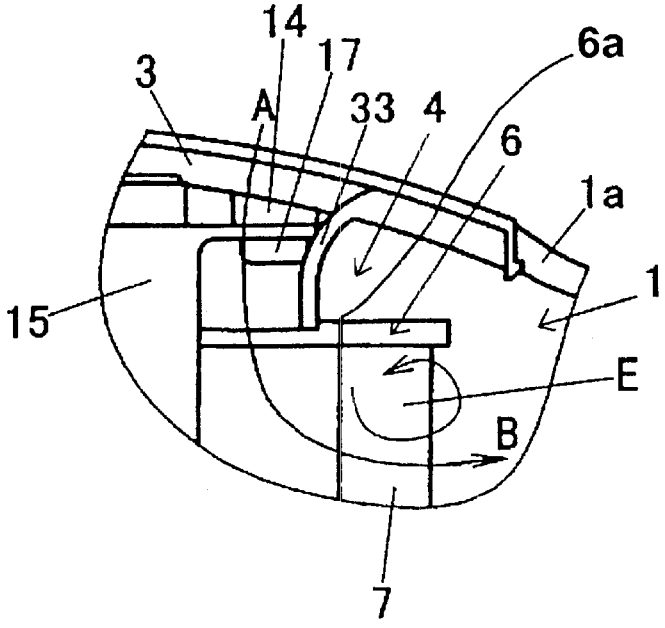
Fig. 10 Conventional Art
FIG. 10 is a partially enlarged cross-sectional view of the conventional hair dryer.
Figure 11:
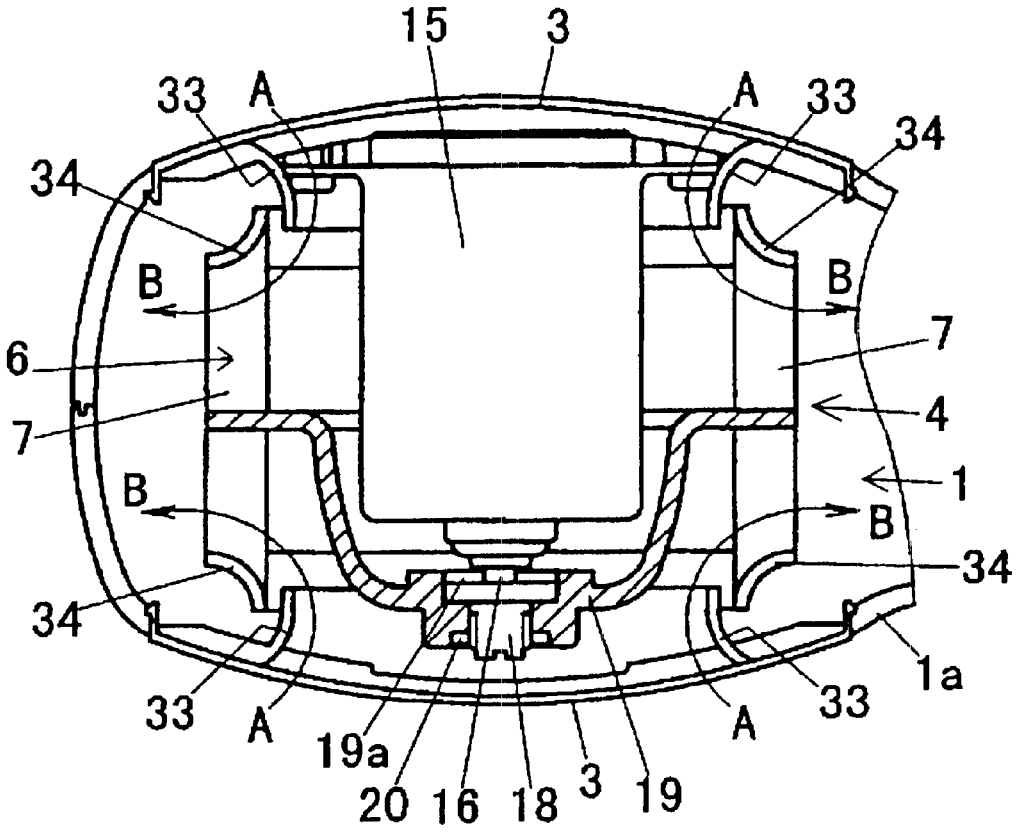
Fig. 11 Conventional Art
FIG. 11 is a partially cross-sectional view of the conventional hair dryer.

Each inlet guide 8 and each blowing guide 9 face each other to form a ring-shaped gap 50 therebetween. The inlet guide 8 and the blowing guide 9 are provided to inhibit both a peripheral air flow (D) (see FIG. 9) which flows toward the air outlet 2 without passing through the centrifugal fan 6 and a reverse air flow (C) (see FIG. 8) which flows from an inside of the main body 1 to the air inlet 3 via a passage 60 (see FIG. 8) formed between an outer surface of the centrifugal fan 6 and the inside surface of the main body 1. Preferably, the distance (width "W" of the gap 50) between the inlet guide 8 and the blowing guide 9 is made as small as possible such that the inlet guide 8 and the blowing guide 9 do not contact with each other. An overlapping length (length "L") is a length along which the inlet guide 8 and the blowing guide 9 face each other along the central axis (Xf) (see FIG. 1). Preferably, the length (L) is determined as long as possible such that the inlet guide 8 and the blowing guide 9 do not narrow the air discharging area of the centrifugal fan 6. In the present embodiment, the inlet guide 8 is provided such that a distance (D) is formed between a tip end (8*a*) of the inlet guide 8 and a side end (7*a*) of the blade 7 (see FIG. 1). Accordingly, the air discharging area of the centrifugal fan 6 is not reduced. As one example, the width (W) is about 2 mm, and the overlapping length (L) is about 3.5 mm.

The heater unit 5 includes a heater cylinder 21 which is mounted in the main body 1. The heater cylinder 21 includes a heater coil 22 which is provided on the inside wall of the heater cylinder 21. The heater coil 22 heats when a power switch is turned on.

Referring to FIG. 3, the handle 13 includes a push switch 23 and a slidable switch 24. For example, the slidable switch 24 is configured to control the output of the hair drier, and the push switch 23 is a power switch which is configured to turn on or off the hair drier. A power cord 25 extends from the bottom of the handle 13. The power cord 25 is connected to the motor 15 and the coil 22 via the push switch 23 and the slidable switch 24.

Referring to FIGS. 1–3, in this hair drier, when the push switch 23 is turned on, the motor rotates the centrifugal fan 6. Accordingly, air is suctioned from the air inlet 3 and sent to the heater unit 5. Because each inlet guide 8 and each blowing guide 9 are positioned to face each other to form the narrow gap 50 therebetween, the peripheral flow (D) (see FIG. 9) is inhibited. Accordingly, a suction air flow (A) from the air inlet 3 may be smoothly transformed to an air flow (B) toward the heater unit 5 (see FIG. 1). Further, as explained in the conventional art, even if a reverse flow (C) is generated (see FIG. 8) because of the pressure loss at the heater unit 5, the reverse flow (C) does not flow into the air inlet 3 because the inlet guide 8 and the blowing guide 9 are provided. Accordingly, air is stably suctioned from the air inlet 3 without reducing an air blowing amount.

The air flow (B) passes through the heater unit 5 to be heated by the coil 22 and then discharged from the air outlet 5.

Although in the present embodiment, the centrifugal fan 6 includes the blowing guide 9, the blowing guide 9 is not necessary if the distance between the inlet guide 8 and the side end portion (6*c*) of the outer circumferential surface (6*b*) of the centrifugal fan 6 is small enough to inhibit both a peripheral air flow (D) and a reverse air flow (C).

Figure 4:
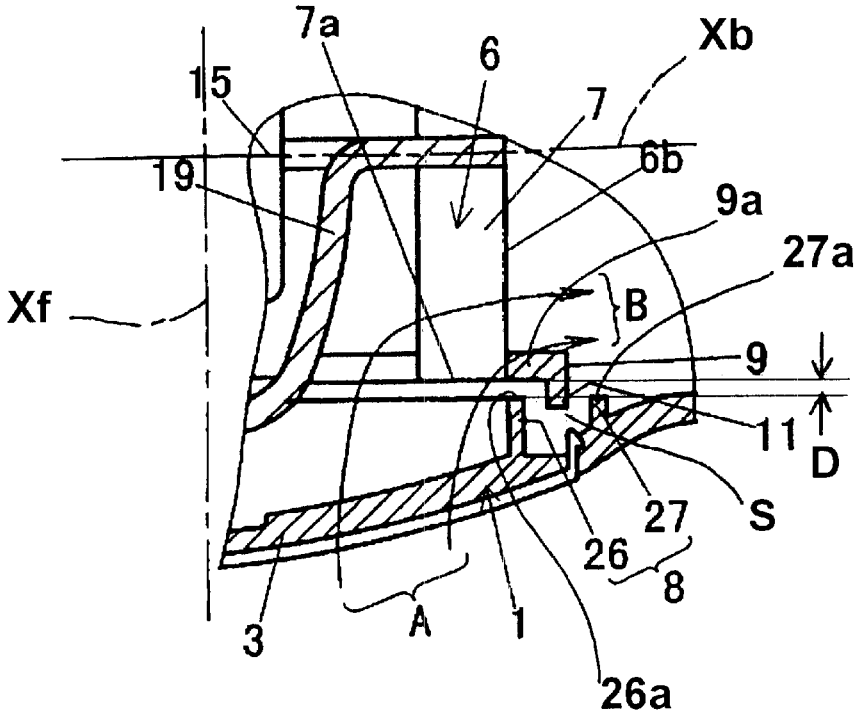
FIG. 4 is a partially enlarged cross-sectional view of a hair dryer according to another embodiment of the present invention.

FIG. 4 is a partially enlarged cross-sectional view of a hair dryer according to another embodiment of the present invention. Referring to FIG. 4, the inlet guide 8 includes an inner guide ring 26 and an outer guide ring 27. The blowing guide 9 has a generally L-shaped cross-section. Namely, the blowing guide 9 includes a radially extending portion (9*a*) and an axially projecting portion 11. The radially extending portion (9*a*) extends along the body central axis (Xb) from the outer circumferential surface (6*b*) of the centrifugal fan 6, and then extends outwardly along the central axis (Xf). The axially projecting portion 11 extends into a space (S) formed between the inner guide ring 26 and the outer guide ring 27.

Since the inlet guide 8 is provided along the outer periphery of the air inlet 3, the area of the air inlet 3 does not reduce. Therefore, a suction air flow (A) from the air inlet 3 is smoothly transformed to an air flow (B) which flows toward the heater unit 5 without reducing the amount of air which is suctioned from the air inlet 3. Further, the inlet guide 8 is provided such that a distance (D) is formed between the side end (7*a*) of the blade 7 and tip ends (26*a* and 27*a*) of the inner and outer guide rings 26 and 27. Accordingly, the inlet guide 8 does not inhibit the rotation of the centrifugal fan 6 and does not narrow the passage of the air flow (B). Namely, the air discharging area of the centrifugal fan 6 is not reduced.

Figure 5:
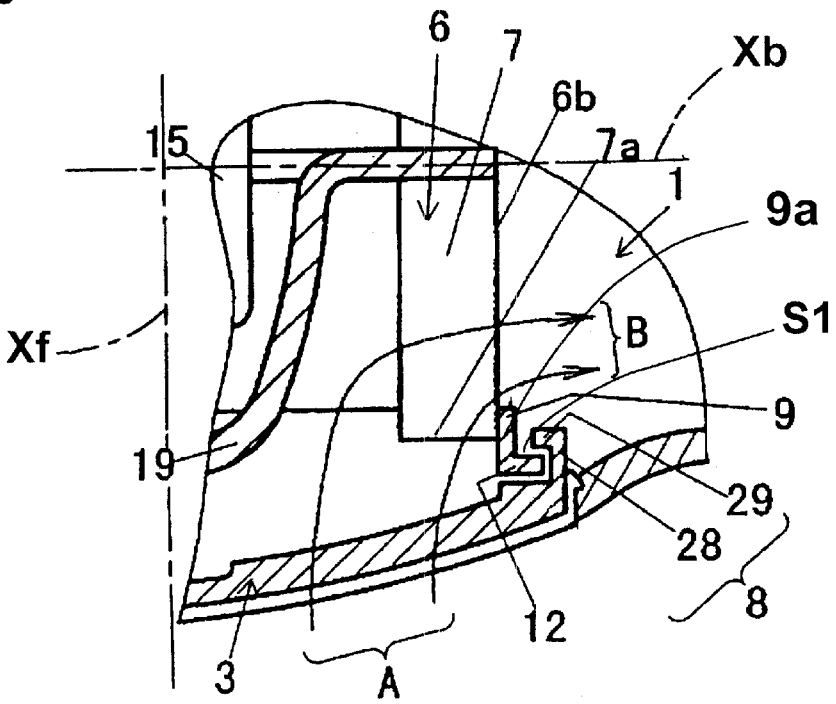
FIG. 5 is a partially enlarged cross-sectional view of a hair dryer according to the other embodiment of the present invention.

FIG. 5 is a partially enlarged cross-sectional view of a hair dryer according to the other embodiment of the present invention. Referring to FIG. 5, the inlet guide 8 has a generally L-shaped cross-section. The inlet guide 8 includes a first axially projecting portion 28 and a first radially extending portion 29. The first axially projecting portion 28 extends inwardly along the central axis (Xf). The first radially extending portion 29 extends along the body central axis (Xb) toward the outer circumferential surface (6*b*) of the centrifugal fan 6. The blowing guide 9 has a generally L-shaped cross-section. Namely, the blowing guide 9 includes a second radially extending portion 12 and a second axially projecting portion (9*a*). The second axially projecting portion (9*a*) extends outwardly along the central axis (Xf). The second radially extending portion 12 extends along the body central axis (Xb) toward the first axially projecting portion 28 of the inlet guide 8. The tip end of the second radially extending portion 12 is positioned in a space (S1) defined by the first axially projecting portion 28 and the first radially extending portion 29.

Therefore, a suction air flow (A) from the air inlet 3 is more smoothly transformed to an air flow (B) which flows toward the heater unit 5 without reducing the amount of air which is suctioned from the air inlet 3.

Figure 6:
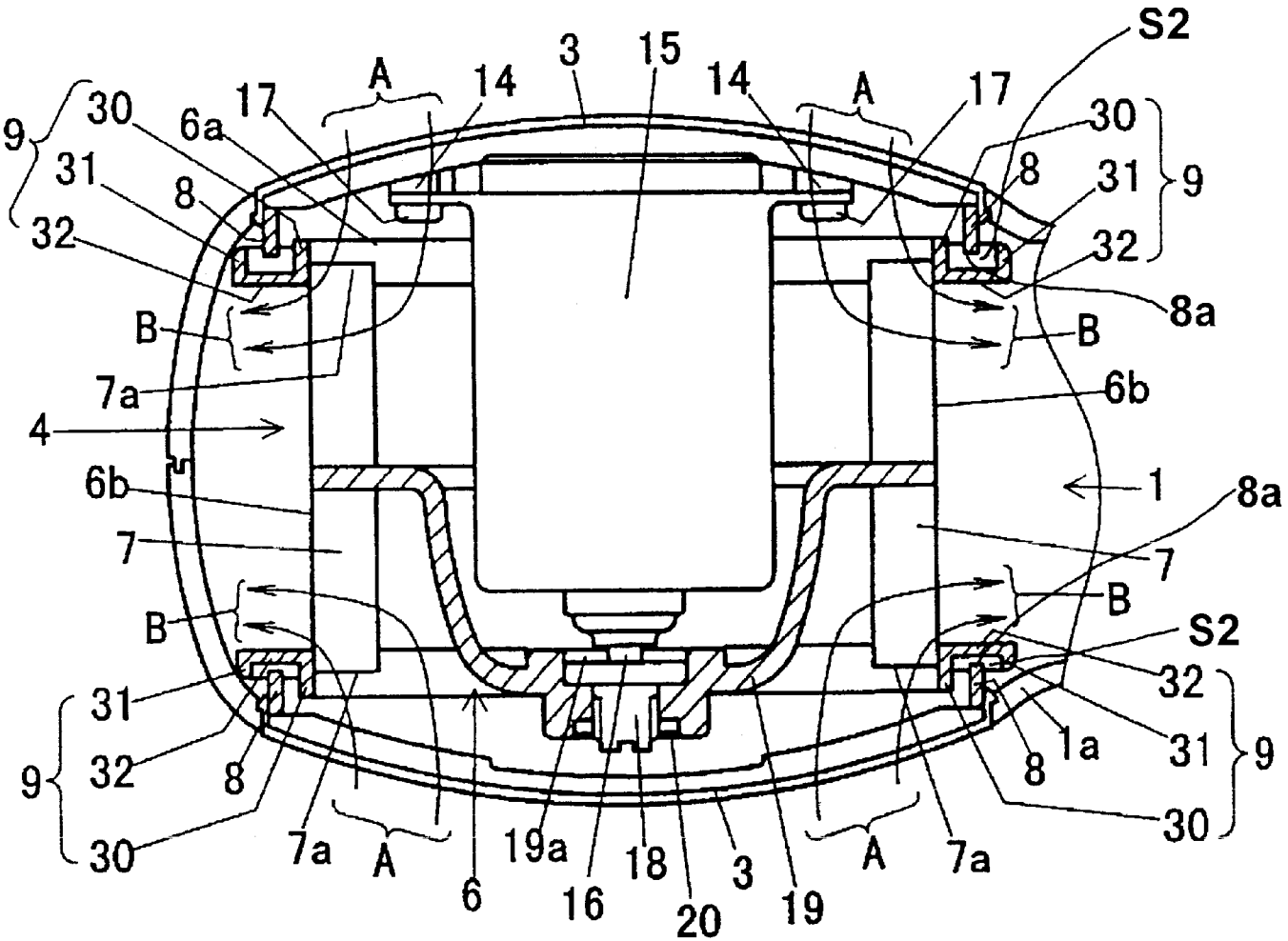
FIG. 6 is a partially cross-sectional view of a hair dryer according to yet another embodiment of the present invention.
Figure 7:
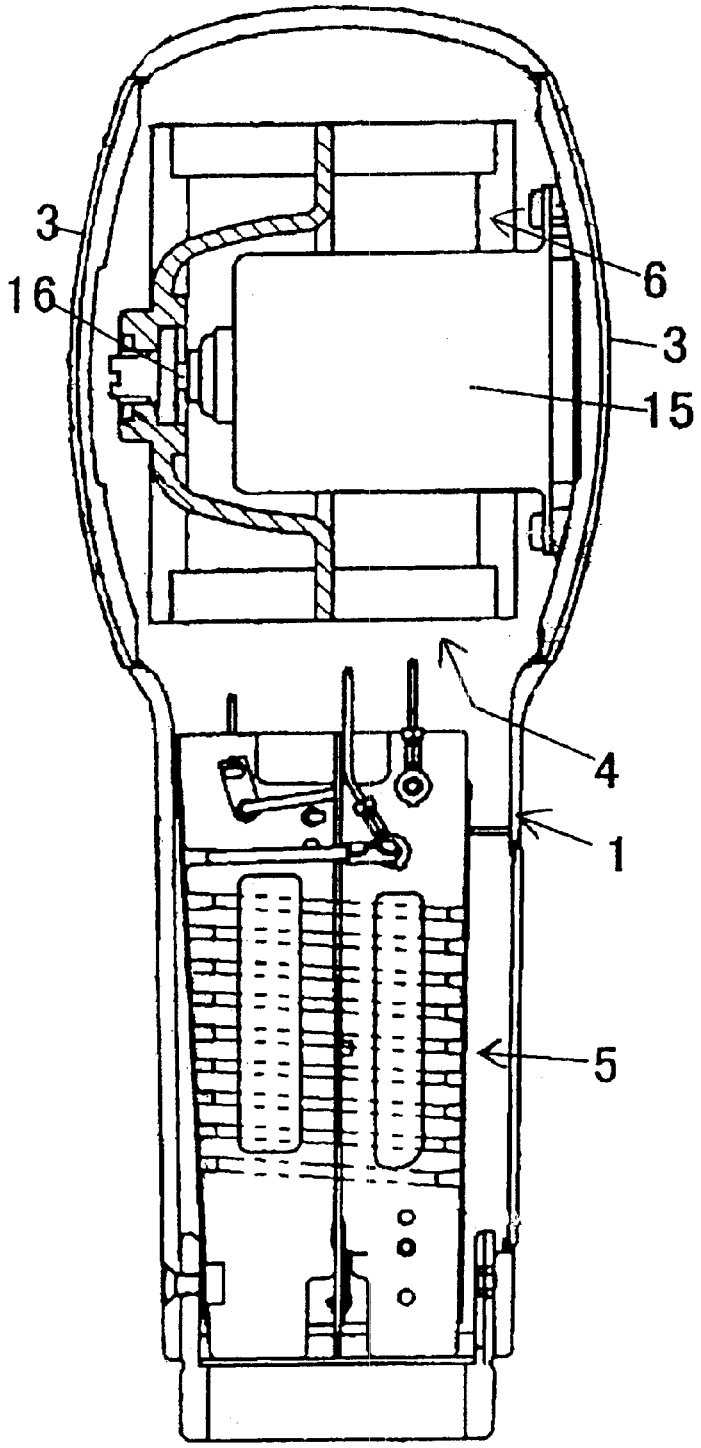
Fig. 7 Conventional Art
FIG. 7 is a sectional top plan view of a conventional hair dryer.

FIG. 6 is a partially cross-sectional view of a hair dryer according to yet another embodiment of the present invention. Referring to FIG. 6, the blowing guide 9 has a generally a cup-shaped cross-section. The blowing guide 9 includes an inner guide ring 30, an outer guide ring 31 and a rib 32 which connects the inner guide ring 30 and the outer guide ring 31. The inner guide ring 30, the outer guide ring 31 and the rib 32 define a concave space (S2). Inlet guides 8 which have generally ring shapes are provided to project from the inside surface of the main body 1. Each inlet guide 8 extends along an entire circumference of the air inlet 3. The blowing guide 9 is provided such that the tip end (8*a*) of the inlet guide 8 is positioned in the space (S2).

Therefore, a suction air flow (A) from the air inlet 3 is more smoothly transformed to an air flow (B) which flows toward the heater unit 5 without reducing the amount of air which is suctioned from the air inlet 3.

Obviously, numerous modifications and variations of the present invention are possible in light of the above teachings. It is therefore to be understood that within the scope of the appended claims, the invention may be practiced otherwise than as specifically described herein.

The present application relates to Japanese Patent Application No. 11-335067, filed Nov. 25, 1999, entitled "Hair Dryer". The contents of that application are incorporated herein by reference in their entirety.

What is claimed as new and desired to be secured by Letters Patent of the United States is:

1. A hair dryer comprising:

a main body having an air outlet along a first axis and at least one air inlet along a second axis, the second axis being not coaxial to the first axis;

a centrifugal fan provided in the main body and configured to blow air toward the air outlet, the centrifugal fan having at least one intake side and an outer circumference, the outer circumference extending substantially along a rotational axis of the centrifugal fan; and at least one inlet guide surrounding the at least one air inlet and partly covering the outer circumference of the centrifugal fan.

2. A hair dryer according to claim 1, wherein the centrifugal fan further comprises at least one blowing guide provided along the outer circumference of the centrifugal fan and extending along the inlet guide.

3. A hair dryer according to claim 2, wherein the at least one inlet guide has an inner guide ring and an outer guide ring which are provided to project from the inside surface of the main body and extending along the entire outer circumference of the at least one air inlet, the inner guide ring being provided inside the outer guide ring, and wherein the at least one blowing guide is provided to be located between the inner guide ring and the outer guide ring.

4. A hair dryer according to claim 3, wherein the at least one blowing guide includes a radially extending portion and an axially projecting portion, the radially extending portion extending in a radial direction of the centrifugal fan, the axially projecting portion projecting along an axial direction of the centrifugal fan and to a space formed between the inner guide ring and the outer guide ring.

5. A hair dryer according to claim 3, wherein the centrifugal fan includes at least one blade extending along the rotational axis of the centrifugal fan, and wherein the at least one inlet guide is provided such that a distance is formed between a side end at the intake side of the blade and tip ends of the inner and outer guide rings.

6. A hair dryer according to claim 2, wherein the at least one inlet guide has a first axially extending portion and a first radially projecting portion, the first axially extending portion extending from the inside surface of the main body along an axial direction of the rotational axis of the centrifugal fan, the first radially projecting portion projecting to the centrifugal fan in a radial direction of the centrifugal fan, and wherein the at least one blowing guide includes a second axially extending portion and a second radially projecting portion, the second axially extending portion extending from the centrifugal fan to the inside surface of the main body along the axial direction of the rotational axis of the centrifugal fan, the second radially projecting portion projecting into a space defined by the first axially extending portion and the first radially projecting portion.

7. A hair dryer according to claim 2, wherein the at least one inlet guide and the at least one blowing guide are provided to inhibit both a peripheral air flow which flows toward the air outlet without passing through the centrifugal fan and a reverse air flow which flows from an inside of the main body to the at least one air inlet via a passage formed between an outer surface of the centrifugal fan and the inside surface of the main body.

8. A hair dryer according to claim 1, wherein the centrifugal fan includes a plurality of blades.

9. A hair dryer according to claim 1, further comprising:

a heater provided in the main body between the centrifugal fan and the air outlet, the centrifugal fan being configured to blow air toward the air outlet via the heater.

10. A hair dryer according to claim 1, wherein the at least one inlet guide has a ring shape and has a diameter larger than that of the centrifugal fan.

11. A hair dryer according to claim 1, wherein the at least one air inlet comprises first and second air inlets which are formed on side surfaces of the main body, respectively, and wherein the at least one inlet guide comprises first and second inlet guides each being provided to project from the inside surface of the main body and each extending along an entire outer circumference of each of the first and second air inlets to surround a part of the outer circumference of the centrifugal fan.

12. A hair dryer according to claim 1, wherein the at least one inlet guide is provided to inhibit both a peripheral air flow which flows toward the air outlet without passing through the centrifugal fan and a reverse air flow which flows from an inside of the main body to the at least one air inlet via a passage formed between an outer surface of the centrifugal fan and the inside surface of the main body.

13. A hair dryer according to claim 1, wherein the centrifugal fan includes at least one blade extending along the rotational axis of the centrifugal fan, and wherein the at least one inlet guide is provided such that a distance is formed between a side end at the intake side of the blade and a tip end of the at least one inlet guide.

14. A hair dryer according to claim 1, wherein the at least one inlet guide extends along an entirety of the circumference of the at least one air inlet to surround and face a part of the outer circumference of the centrifugal fan along an entirety of the circumference of the centrifugal fan.

15. A hair dryer comprising:

a main body having an air outlet along a first axis and at least one air inlet along a second axis, the second axis being not coaxial to the first axis;

a centrifugal fan provided in the main body and configured to blow air toward the air outlet, the centrifugal fan having at least one intake side and an outer circumference extending along a rotational axis of the centrifugal fan;

at least one blowing guide having a concave space and provided along the outer circumference of the centrifugal fan; and at least one inlet guide surrounding the at least one air inlet and extending to discontinuously interlock in the concave space of the at least one blowing guide.

16. A hair dryer according to claim 15, wherein the at least one blowing guide includes an inner guide ring, an outer guide ring and a rib which connects the inner guide ring and the outer guide ring to define the concave space.

17. A hair dryer according to claim 15, wherein the at least one inlet guide extends along an entirety of the circumference of the at least one air inlet, and wherein the portion of the at least one inlet guide is positioned in the concave space along an entirety of the circumferential length of the at least one inlet guide.

18. A hair dryer according to claim 15, wherein the at least one blowing guide is provided along an entirety of the circumference of the centrifugal fan to face the inlet guide.

19. A hair dryer comprising:

a main body having an air outlet along a first axis and at least one air inlet along a second axis, the second axis being not coaxial to the first axis;

a centrifugal fan provided in the main body and configured to blow air toward the air outlet, the centrifugal fan having at least one intake side and an outer circumference, the outer circumference being extending along a rotational axis of the centrifugal fan; and air guiding means for guiding air beyond the at least one intake side of the centrifugal fan from the at least one air inlet of the main body.

20. A hair dryer comprising:

a main body having an air outlet along a first axis and at least one air inlet along a second axis, the second axis being not parallel to the first axis;

a centrifugal fan provided in the main body and configured to blow air toward the air outlet, the centrifugal fan having at least one intake side and an outer circumference, the outer circumference being extending along a rotational axis of the centrifugal fan; and at least one air guiding device configured to guide air beyond the at least one intake side of the centrifugal fan from the at least one air inlet of the main body.

21. A hair dryer according to claim 20, wherein the at least one air guiding device comprises at least one air inlet guide and at least one blowing guide, the at least one air inlet guide being provided inside the body and surrounding the at least one air inlet, the at least one blowing guide being provided on the outer circumference of the centrifugal fan.

22. A hair dryer according to claim 21, wherein the at least one air inlet guide and at least one blowing guide are configured to discontinuously complement each other.

* * * * *